US010336429B1

(12) United States Patent
Amerling et al.

(10) Patent No.: US 10,336,429 B1
(45) Date of Patent: Jul. 2, 2019

(54) COWLING FOR OUTBOARD MOTORS HAVING AN AIR INTAKE SYSTEM THAT PROVIDES WATER MANAGEMENT

(71) Applicant: Brunswick Corporation, Mettawa, IL (US)

(72) Inventors: Steven J. Amerling, Fond du Lac, WI (US); Evan N. Kobman, Brandon, WI (US); Thomas F. Nickols, Oakfield, WI (US); Chetan A. Dharmadhikari, North Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/891,507

(22) Filed: Feb. 8, 2018

(51) Int. Cl.

| | |
|---|---|
| ***B63H 20/32*** | (2006.01) |
| ***F02M 35/14*** | (2006.01) |
| ***F02M 35/12*** | (2006.01) |
| ***F02M 35/16*** | (2006.01) |

(52) U.S. Cl.
CPC ..... *B63H 20/32* (2013.01); *F02M 35/1233* (2013.01); *F02M 35/14* (2013.01); *F02M 35/168* (2013.01)

(58) Field of Classification Search
CPC ..... B63H 20/32; F02M 35/1233
See application file for complete search history.

(56) References Cited

U.S. PATENT DOCUMENTS

| | | | | |
|---|---|---|---|---|
| 4,860,703 | A * | 8/1989 | Boda | B63H 20/32 123/195 P |
| 6,463,902 | B1 | 10/2002 | Curtis et al. | |
| 6,932,662 | B1 * | 8/2005 | Walczak | B63H 20/32 440/77 |
| 7,517,265 | B2 * | 4/2009 | Takahashi | F02M 35/09 440/77 |
| 7,524,223 | B2 * | 4/2009 | Ochiai | B63H 20/32 440/88 A |
| 8,651,906 | B1 * | 2/2014 | Morton | B63H 20/32 440/77 |
| 8,690,623 | B2 * | 4/2014 | Suzuki | B63H 20/001 440/88 F |
| 2007/0054569 | A1 * | 3/2007 | Murai | B63H 20/32 440/77 |
| 2008/0003896 | A1 * | 1/2008 | Takashi | F02M 35/09 440/77 |
| 2013/0157534 | A1 * | 6/2013 | Suzuki | B63H 20/001 440/88 F |

* cited by examiner

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A cowling for an outboard motor has port and starboard intake ports that direct flow of intake air into the cowling and extend downwardly along the aftward side of the cowling and face laterally outwardly. A duct system receives and conveys intake air intake ports to an intake conduit for the outboard motor. The duct system includes port and starboard intake troughs that extend alongside the intake ports and redirect the intake air from a generally lateral flow into the intake ports to a generally vertically downward flow and then to a generally forward flow towards the intake conduit. Port and starboard baffles that extend alongside the intake ports and direct flow of water into port and starboard channels located alongside the baffles, respectively. The channels drain the water by gravity depending on tilt and trim orientation of the outboard motor.

27 Claims, 6 Drawing Sheets

COWLING FOR OUTBOARD MOTORS HAVING AN AIR INTAKE SYSTEM THAT PROVIDES WATER MANAGEMENT

FIELD

The present disclosure relates to marine propulsion devices, and more particularly to cowlings for outboard motors having an air intake system that provides water management.

BACKGROUND

The following U.S. patent is incorporated herein by reference:

U.S. Pat. No. 8,651,906 discloses an apparatus for intake of air to an outboard motor, which includes an inlet receiving a mixture of air and water from atmosphere surrounding the outboard motor and an outlet discharging the air. A conduit extends between the inlet and the outlet. The conduit has a vertically downwardly oriented first flow path, a vertically upwardly oriented second flow path, and a junction joining the first and second flow paths. The junction is oriented with respect to the first and second flow paths such that both centrifugal and gravitational forces separate the water from the air as the mixture flows there through.

U.S. Pat. No. 6,932,662 discloses a flow conditioning member attached to a distal end, or lip, of an air conduit within a space formed by inner and outer walls of a cowl for an outboard motor. The flow conditioning member is shaped to decrease the likelihood that a thickened boundary layer will form within the conduit as air flows from an air passage formed through the cowl to an air intake system of an engine. The flow conditioning member is shaped to block the passage of water from the air passage to the air conduit while improving the efficiency of air flow from the air passage, into a space between the inner and outer walls, and into the air conduit.

U.S. Pat. No. 6,463,902 discloses an air supply system for a marine engine, which includes an air duct, or sound attenuator cavity, that receives air through a plurality of inlets and directs air to an outlet of the air duct disposed over a throttle body of an air intake manifold. An air filter assembly is shaped to be attached to a wall of the air duct with a filter medium portion extending into the cavity of the air duct and an outlet port or nipple, extending out of the air duct. A compressor is connected in fluid communication with the outlet port of the air filter assembly through the use of a flexible tube, such as a rubber hose, in order to provide filtered air to the compressor. The air filter assembly is easily removed for inspection and/or replacement and is located with its filter medium within the protective housing of the air duct.

U.S. Pat. No. 4,860,703 discloses an outboard marine motor housed by a cowl assembly having an upper cowl section and a lower cowl section and including various features for improving the structural integrity of the cowl assembly and for providing a water-resistant seal at the joint between the cowl sections and at various points of entry of cables and other mechanical devices. An improved air intake duct prevents the entry of water into the interior cavity of the cowl assembly. The air intake duct is disposed in an air intake opening provided in the top rear portion of the upper cowl section. The air intake duct includes a bottom wall, a pair of upstanding side walls connected thereto, and an upstanding back wall extending between the side walls. The top wall has an upwardly facing opening which forms an air inlet for allowing air to pass into the interior of the cowl assembly, to provide combustion air for the engine of the outboard motor. The air intake duct provides an air flow path whereby air flows forwardly toward the back wall and is then deflected upward to pass through the air inlet in the top wall. Any moisture contained within the air is trapped and prevented from entering the cavity due to the upward deflection of the air.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In certain examples disclosed herein, a cowling for an outboard motor has port and starboard intake ports that direct flow of intake air into the cowling. The port and starboard intake ports extend downwardly along the aftward side of the cowling and face laterally outwardly. A duct system receives and conveys intake air from the port and starboard intake ports to an intake conduit for the outboard motor. The duct system includes port and starboard intake troughs that extend alongside the port and starboard intake ports and redirect the intake air from a generally lateral flow into the port and starboard intake ports to a generally vertically downward flow and then to a generally forward flow towards the intake conduit. Port and starboard baffles extend alongside the port and starboard intake ports and direct flow of water into port and starboard channels located alongside the port and starboard baffles, respectively. The port and starboard channels drain the water by gravity depending on tilt and trim orientation of the outboard motor. A crossover channel laterally connects the port and starboard channels. The crossover channel permits lateral flow of water from the port intake port to the starboard intake trough or from the starboard intake port to the port intake trough, depending on the tilt and trim orientation of the outboard motor. A series of port walls are spaced apart from each other in the axial direction and extend laterally into the port intake trough. A series of starboard walls are spaced apart from each other in the axial direction and extend laterally into the starboard intake trough. Spaces are defined between the port walls and between the starboard walls and provide flow paths for the intake air as the intake air is redirected from the generally lateral flow into the port and starboard intake ports to the generally vertically downward flow towards the intake conduit.

DETAILED DESCRIPTION OF THE DRAWINGS

Figure 1:
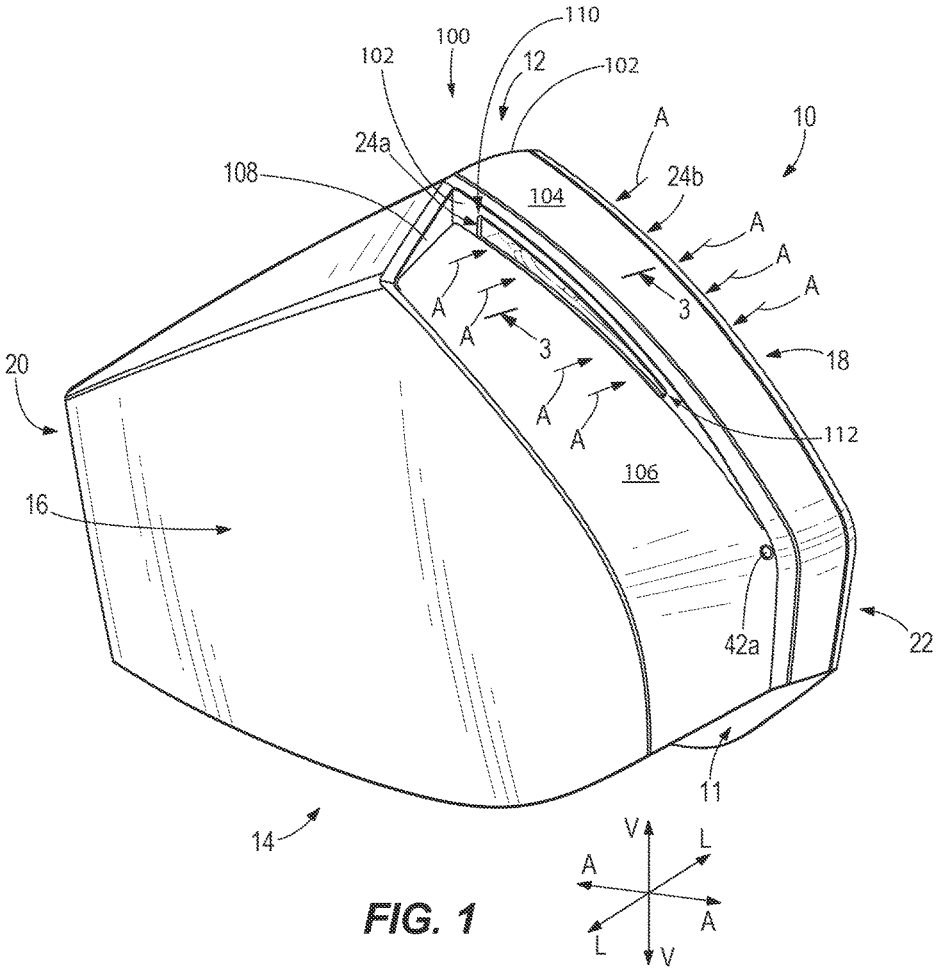
FIG. 1 is a perspective view of a top cowling for an outboard motor.

FIG. 1 is a perspective view of a top cowling 10 for an outboard motor. The top cowling 10 extends from top 12 to bottom 14 in a vertical direction V, from port side 16 to starboard side 18 in a lateral direction L that is perpendicular to the vertical direction V, and from forward side 20 to aftward side 22 in an axial direction A that is perpendicular to the vertical direction V and perpendicular to the lateral direction L. Port and starboard intake ports 24*a*, 24*b* each extend downwardly along the aftward side 22 of the top cowling 10. Each of the port and starboard intake ports 24*a*, 24*b* face outwardly in the lateral direction L and form a generally triangular shape having a wide top end and a relatively narrow bottom end.

During operation of the outboard motor, intake air for combustion in an internal combustion engine of the outboard motor flows generally laterally into the port and starboard intake ports 24*a*, 24*b*, as shown at arrows A in FIG. 1.

Through research and experimentation, the present inventors have realized that it is necessary to manage the intake air and any ingress of water into the top cowling 10 so that air is efficiently conveyed for combustion in an internal combustion engine within the cowl interior, and so that water is not conveyed to the internal combustion engine, but rather is separated from the flow of air and drained from the outboard motor. The present inventors have further determined that water can potentially enter the port and starboard intake ports 24*a*, 24*b* via mist associated with the air, rainwater, or in the form of a wave surge (e.g., trailing wake) onto the outboard motor from the body of water in which the outboard motor is operating. The present inventors have further determined that it would be desirable to provide an air intake system associated with the port and starboard intake ports 24*a*, 24*b* that separates and drains water from all these sources. For example, the present inventors have determined it would be desirable for the intake system to condense any suspended water (e.g., mist) out of the intake airflow prior to it being introduced to the internal combustion engine. The present inventors have further determined that it would be desirable for the intake system to effectively route rainwater that enters the port and starboard intake ports 24*a*, 24*b* out of the outboard motor, rather than allow it to be introduced to the internal combustion engine. The present inventors have further determined that it would be desirable for the intake system to redirect the forward momentum of a wave surge back out of the port and starboard intake ports 24*a*, 24*b* and/or to a drain for removal from the outboard motor.

Through research and experimentation, the present inventors have also determined that the direction in which the port and starboard intake ports 24*a*, 24*b* are facing (i.e. orientation) will vary during operation of the outboard motor, which can affect the functionality of the intake system and its water management features. For example, it is well known in the art that outboard motors are steerable about a vertical steering axis between port and starboard steering orientations. It is also well known in the art that outboard motors are trim-able about a horizontal trim axis into and between a fully trimmed up position and a fully trimmed down position. As the outboard motor is steered and/or trimmed, the direction (orientation) of the port and starboard intake ports 24*a*, 24*b* will vary with respect to rainfall and with respect to wave surges onto the outboard motor. For example, when the outboard motor is fully trimmed down, exposure of the port and starboard intake ports 24*a*, 24*b* to infiltration of rainwater is less compared to when the outboard motor is fully trimmed up and steered towards either the port or starboard side. In the latter position, one of the port or starboard intake ports 24*a*, 24*b* will face generally upwardly towards the falling rain, thus increasing the chance that rainwater will enter the system. Also, during normal operation of the outboard motor it will be trimmed down into the body of water, at which time it will be susceptible to wave surges from the body of water. This typically is not a cause for concern when the outboard motor is trimmed up and out of use.

The present disclosure is based on the above-described realizations made by the present inventors, and provides a new cowling for an outboard motor having novel features for managing intake of air for combustion, while at the same time protecting the outboard motor from ingress of water via, for example, mist, rain or wave surge.

Figure 2:
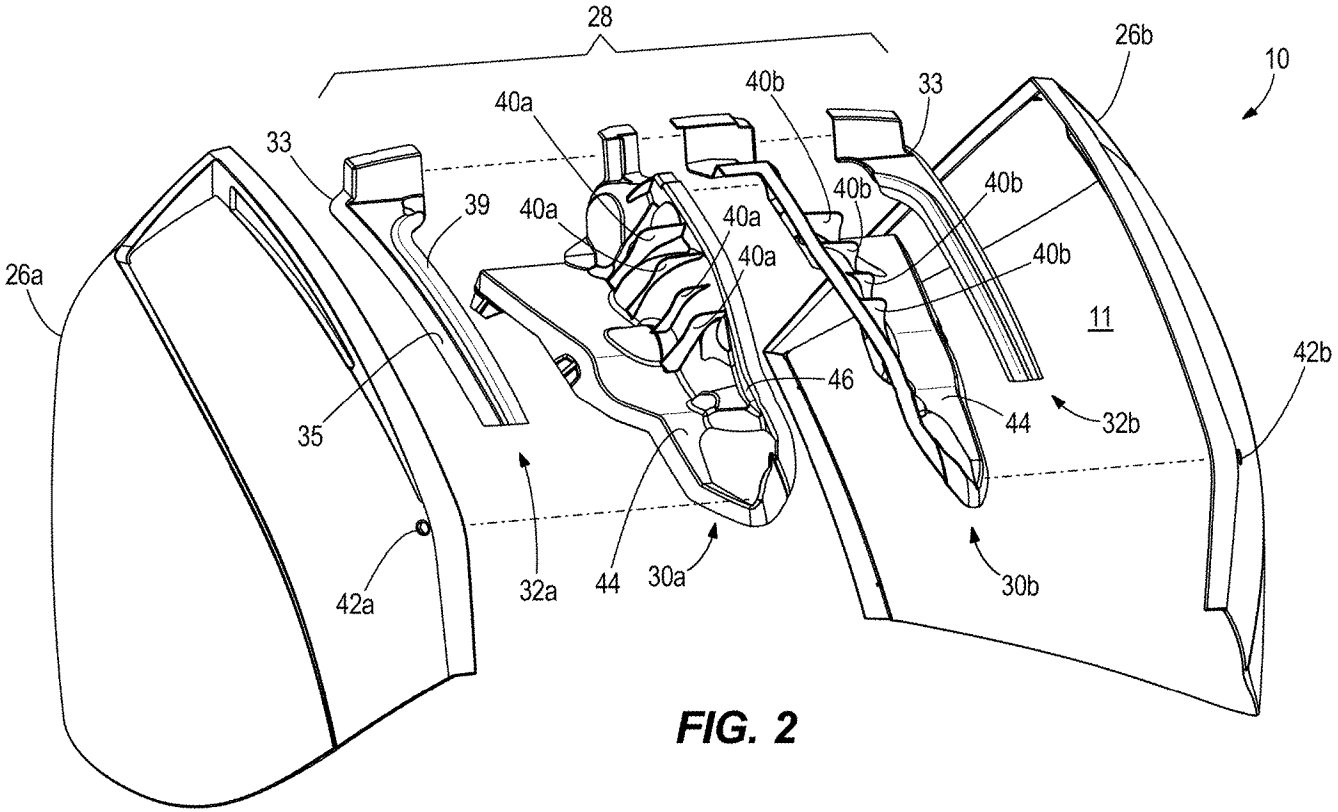
FIG. 2 is an exploded view of the top cowling and a duct system that receives and conveys intake air from port and starboard intake ports on the top cowl to an internal combustion engine on the outboard motor.
Figure 3:
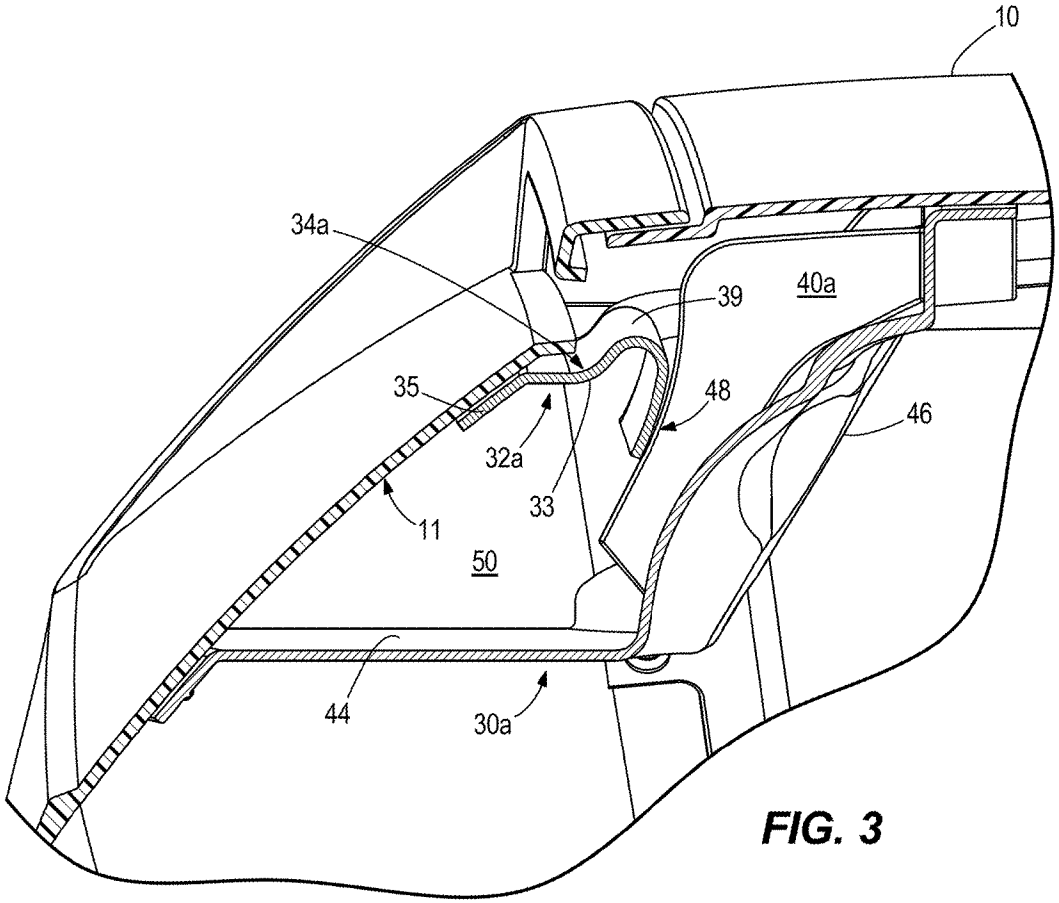
FIG. 3 is a view of section 3-3, taken in FIG. 3.

Referring to FIGS. 2 and 3, the top cowling 10 has port and starboard top cowling halves 26*a*, 26*b* that are coupled together. A duct system 28 according to the present disclosure is located in the interior of top cowling 10 along the centerline and is configured to receive and convey the lateral flow of intake air from the port and starboard intake ports 24*a*, 24*b* to an intake conduit on an internal combustion engine of the outboard motor. The intake conduit and internal combustion engine are not shown in the drawings, but these are conventional items that are normally located in the interior of the top cowling 10, forwardly of the duct system 28.

The duct system 28 includes port and starboard intake troughs 30*a*, 30*b* that extend alongside the port and starboard intake ports 24*a*, 24*b*, respectively. As will be described further herein below, the port and starboard intake troughs 30*a*, 30*b* are configured to redirect the intake air from the generally lateral flow shown in FIG. 1 to a generally vertically downward flow and then forwardly to the noted intake conduit for the internal combustion engine. The duct system 28 also includes port and starboard baffles 32*a*, 32*b* that extend alongside the respective port and starboard intake ports 24*a*, 24*b* and above the respective port and starboard intake troughs 30*a*, 30*b*. The port and starboard baffles 32*a*, 32*b* are configured to direct flow of rainwater and/or water from a wave surge into port and starboard channels 34*a*, 34*b* that extend alongside the port and starboard baffles 32*a*, 32*b*, respectively. Each of the port and starboard channels 34*a*, 34*b* drain the rainwater by gravity in a direction that depends on the tilt and trim orientation of the outboard motor, all as will be described further herein below.

The port and starboard baffles 32*a*, 32*b* each include a baffle body 33 having a laterally outer side 35 fastened to the interior surface 11 of the top cowling 10 via a suitable fastener, for example an adhesive. The baffle body 33 also has a laterally inner side having a raised curved upper surface 39. As show in FIG. 3, the port and starboard channels 34*a*, 34*b* are located laterally between the raised curved upper surface 39 and the interior surface 11 of the top cowling 10, in the space between the interior surface 11 of the top cowling 10 and the respective baffle 32*a*, 32*b*. Port and starboard drainage ports 42*a*, 42*b* are formed through the top cowling 10 aft and below the port and starboard channels 34*a*, 34*b* and drain water by gravity along the port and starboard channels 34*a*, 34*b* along the port and starboard troughs 30*a* and 30*b* to outside the top cowling 10 when the outboard motor is trimmed down.

Figure 4:
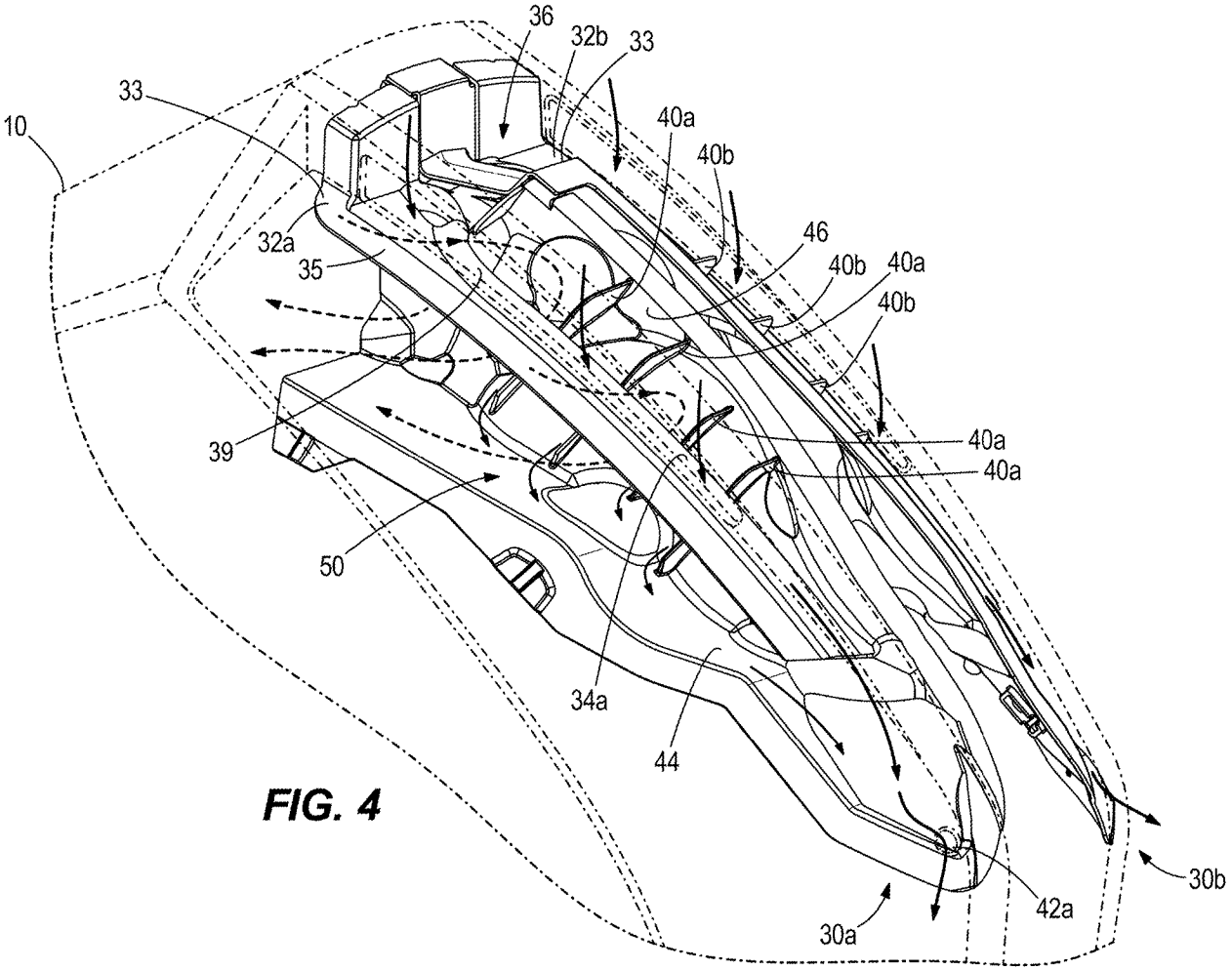
FIG. 4 is a view showing the port side of the top cowling in phantom line and showing inflow of intake air and drainage of water when the outboard motor is trimmed down.
Figure 5:
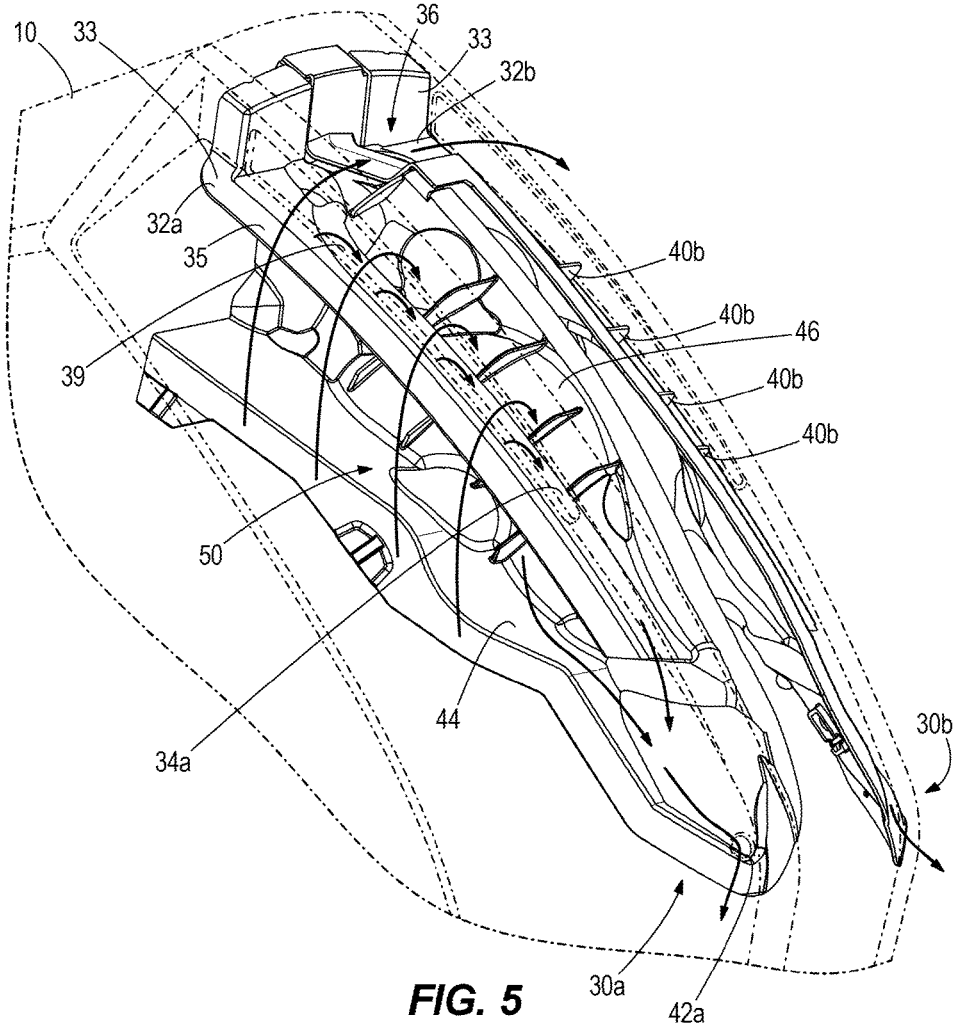
FIG. 5 is a view like FIG. 4, showing ingress and drainage of water, for example water from a wave surge, when the outboard motor is trimmed down.
Figure 6:
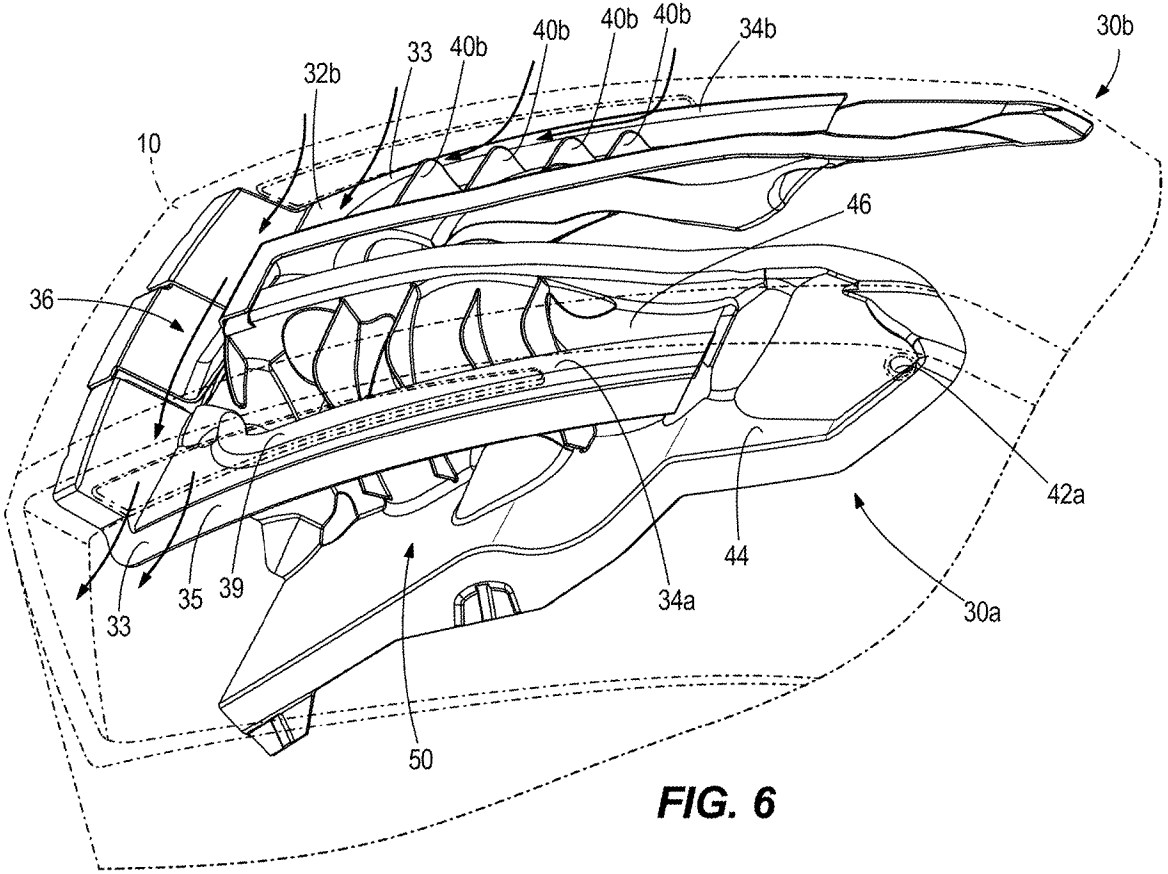
FIG. 6 is a view like FIG. 4, showing drainage of water, for example rainwater, when the outboard motor is trimmed up and steered towards starboard.

As shown most clearly in FIGS. 4-6, the duct system 28 also includes a crossover channel 36 that connects the port and starboard channels 34*a*, 34*b*. The crossover channel 36 permits lateral flow of water, e.g. rainwater or water from a wave surge, from the port intake port 24*a* to the starboard intake port 24*b* and vise versa depending on the tilt and trim orientation of the outboard motor. The port and starboard intake troughs 30*a*, 30*b* and crossover channel 36 together form a U-shape when viewed from above the duct system 28.

Referring to FIGS. 2-3, the port and starboard intake troughs 30*a*, 30*b* each includes an elongated base wall 44 and an elongated sidewall 46 that extends upwardly from the base wall 44. A plurality of port walls 40*a* is axially spaced apart from each other and laterally extend into the port intake trough 30*a*. A plurality of starboard walls 40*b* is axially spaced apart from each other and laterally extend from the elongated sidewall 46 into the starboard intake trough 30*b*. The spaces that are axially defined between the port walls 40*a* and the starboard walls 40*b* define flow paths for the intake air as it is redirected by the duct system 28 from the lateral flow A to a generally downward flow. The port and starboard walls 40*a*, 40*b* and spaces there between encourage minor vortices in the intake airflow, thus driving water (e.g. mist) against the walls 40*a*, 40*b* where the water collects and is drained. Referring to FIG. 3, the raised curved upper surface 39 of the respective port and starboard baffles 32*a*, 32*b* extends downwardly and laterally alongside of a lateral outer edge 48 of the port and starboard walls 40*a*, 40*b*. The port and starboard intake troughs 30*a*, 30*b* and port and starboard baffles 32*a*, 32*b* together define an intake passage 50 for conveying intake air from the noted generally downward flow in the spaces between the port and starboard walls 40*a*, 40*b* to the noted generally forward flow to the intake conduit for the internal combustion engine. The intake passage 50 encourages a major vortice in the intake airflow, thus further driving water against the base wall 44 and sidewall 46 and bottom of the baffle 39. The elongated base wall 44 forms a sloped floor for drainage of water by gravity from the intake passage 50, as will be described further herein below. Referring to FIG. 1, port and starboard drainage ports 42*a*, 42*b* are formed through the top cowling 10 and are configured to drain the water from the intake passage 50 to outside the top cowling 10.

FIG. 4 is a view of the port side 14 of the top cowling 10 in phantom line and showing inflow of intake air and drainage of water when the outboard motor is trimmed down. As shown in dashed-line arrows, the intake air flows laterally into the port and starboard intake ports 24*a*, 24*b* and is directed over the raised curved upper surface 39 and downwardly through the spaces between the port and starboard walls 40*a*, 40*b*. The raised curved upper surface 39 distributes and facilitates improved air flow efficiency. Segregation of the lateral flow of intake air into the respective spaces encourages an even distribution of the intake air along the length of the port and starboard intake ports 24*a*, 24*b*. The port and starboard walls 40*a*, 40*b* also provide increased duct area across which the air flows, thus encouraging separation of water (e.g., mist) from the flow of air. Water that condenses and/or collects on the port and starboard walls 40*a*, 40*b* and on the sidewall 46 drains by gravity to the intake passage 50 and then from the outboard motor via the drainage ports 42*a*, 42*b*, as shown by thin solid line arrows. Air that enters the intake passage 50 is drawn forwardly to the noted intake conduit for the internal combustion engine. Rainwater that enters the port and starboard intake ports 24*a*, 24*b*, as shown by solid arrows in FIG. 4, is deflected by the port and starboard baffles 32*a*, 32*b* into the port and starboard channels 34*a* 34*b* and drained by gravity from the outboard motor via the port and starboard drainage ports 42*a*, 42*b*.

FIG. 5 is a view like FIG. 4, showing ingress and drainage of water, for example water from a wave surge, when the outboard motor is trimmed down. As shown by solid arrows in FIG. 5, water that surges onto the top cowling 10 from the body of water in which the outboard motor is operating can possibly enter the port and starboard intake ports 24*a*, 24*b*. The port and starboard baffles 32*a* 32*b* are configured to deflect the surge of water into the port and starboard channels 34*a*, 34*b*, which drain the water by gravity to the port and starboard drainage ports 42, 42*b*. This limits the amount of water inflow to the intake passage 50 and limits the chance that water is ingested into the internal combustion engine. In situations where the surge of water is powerful enough to run upwardly alongside one of the port or starboard baffles 32*a*, 32*b*, the crossover channel 36 permits the water to flow laterally to the opposite side and then drain by gravity down the opposite side. This further limits the chance that water surges over the port and/or starboard baffle 32*a*, 32*b*, into the intake passage 50 and continue to push out the forward trough opening. In cases of a wave surge that surges over the port or starboard baffle 32*a*, 32*b*, the water in the intake passage 50 drains by gravity via the port and starboard drainage ports 42*a*, 42*b*, as described above. The port and starboard walls 40*a*, 40*b* are impacted by the wave surge and slow the forward momentum of the wave surge, thus encouraging drainage via the port and starboard drainage ports 42*a*, 42*b*, rather than ingestion into the internal combustion engine via the noted intake conduit. Surge water entering port and starboard intake ports 24*a*, 24*b* has an inward and forward momentum. To stop the progression of water towards the forward trough opening, the water is impeded by this motion due to the port and starboard walls 40*a*, 40*b*. This redirection is enough to slow the water down under a limited surge condition and allow gravity to drain the water down the trough 30*a*, 30*b* and out drains 42*a*, 42*b*. The duct system 28, including the port and starboard baffles 32*a*, 32*b* and crossover channel 36 also advantageously allows the forward momentum of the wave surge to dissipate through the crossover channel 36 and out the opposing intake port or drainage ports. The spaces between the plurality of port walls 40*a* and between the plurality of starboard walls 40*b* cause the intake air to travel in a circular motion, which separates water droplets from the intake air, the separated water droplets draining from the port and starboard drainage channels 34*a*, 34*b*. The plurality of port walls 40*a* and plurality of starboard walls 40*b* reduce speed of the water entering the cowling during a sudden boat stop, and direct the water towards the port and starboard drainage channels 34*a*, 34*b*.

FIG. 6 is a view like FIG. 4, showing drainage of water, for example rainwater, when the outboard motor is trimmed up and steered towards starboard. In this orientation, the starboard intake port 24*b* is facing generally upwardly in the vertical direction V and thus is susceptible to receiving direct flow of rainwater. In this orientation, the starboard baffle 32*b* deflects the rainwater to the starboard channel 34*b*. Depending on the angle of trim, the rainwater is free to drain by gravity either to the crossover channel 36, as shown, or to the starboard drainage port 42*b*. In the illustrated example, the rainwater flows by gravity from the starboard channel 34*b* to the crossover channel 36, and from the crossover channel 36 to the port intake port 24*a*. The water then drains out of the upper end of the port intake port 24*a*, as shown. It will thus be seen that the duct system 28, including the port and starboard baffles 32*a*, 32*b* and cross-over channel 36 allows rainwater entering one of the port and starboard intake ports 24*a*, 24*b* to flow from the respective higher-side baffle, into the cross-over channel 36, to the low side baffle, and out the low side inlet port. The crossover channel 36 advantageously prevents water from collecting in the duct system 28 when the outboard motor is in a full trim/turn position.

The present disclosure thus provides a top cowling 10 having a peak 100 that is axially located between the forward and aftward sides 20, 22. The peak 100 is defined by a laterally elongated top edge 102. Port and starboard sidewalls (FIG. 1 shows the port sidewall 102) extend aftwardly from the peak 100 and vertically downwardly from opposite sides of a laterally central portion 104 of the aftward side 22. The port and starboard intake ports 24*a*, 24*b* are formed through the port and starboard sidewalls 102 and extend downwardly along only the aftward side 22 of the cowling. Laterally outer surfaces (FIG. 1 shows the port laterally outer surface 106) are located on opposite sides of the laterally central portion 104, and are formed such that water can be conveyed into the respective port and starboard intake ports 24*a*, 24*b*, as shown by arrows A in FIG. 1. Aftward sidewalls (FIG. 1 shows the port aftward sidewall 108) are located on opposite sides of the laterally central portion 104, aftwardly of the peak 100. The aftward sidewalls 108 extend transversely relative to the port and starboard sidewalls 102. The port and starboard sidewalls 102 are generally parallel with respect to each other. The port and starboard intake ports 24*a*, 24*b* have a generally triangular shape with a top end 110 located aftwardly of the peak 100 and a bottom end 112 located further from the peak 100 than the top end 110. The top end 110 is larger than the bottom end 112.

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

What is claimed is:

1. A cowling for an outboard motor, the cowling extending from top to bottom in a vertical direction, from port side to starboard side in a lateral direction that is perpendicular to the vertical direction, and from forward side to aftward side in an axial direction that is perpendicular to the vertical direction and perpendicular to the lateral direction, the cowling comprising:

port and starboard intake ports that direct flow of intake air into the cowling, the port and starboard intake ports extending downwardly along the aftward side of the cowling and facing outwardly in the lateral direction; and a duct system located in the cowling, the duct system being configured to receive and convey intake air from the port and starboard intake ports to an intake conduit for the outboard motor;

wherein the duct system comprises port and starboard intake troughs that extend alongside the port and starboard intake ports and redirect the intake air from a generally lateral flow into the port and starboard intake ports to a generally vertically downward flow and then to a generally forward flow towards the intake conduit;

wherein the duct system further comprises port and starboard baffles that extend alongside the port and starboard intake ports and direct flow of water into port and starboard channels located alongside the port and starboard baffles, respectively, wherein the port and starboard channels drain the water by gravity from the outboard motor; and wherein the port and starboard baffles each comprises an elongated baffle body that has a laterally outer side located proximate to an interior surface of the cowling and an inner side having a raised curved upper surface, wherein the respective port and starboard channels are located laterally between the raised curved upper surface and the interior surface of the cowling.

2. A cowling for an outboard motor, the cowling extending from top to bottom in a vertical direction, from port side to starboard side in a lateral direction that is perpendicular to the vertical direction, and from forward side to aftward side in an axial direction that is perpendicular to the vertical direction and perpendicular to the lateral direction, the cowling comprising:

port and starboard intake ports that direct flow of intake air into the cowling, the port and starboard intake ports extending downwardly along the aftward side of the cowling and facing outwardly in the lateral direction; and a duct system located in the cowling, the duct system being configured to receive and convey intake air from the port and starboard intake ports to an intake conduit for the outboard motor;

wherein the duct system comprises port and starboard intake troughs that extend alongside the port and starboard intake ports and redirect the intake air from a generally lateral flow into the port and starboard intake ports to a generally vertically downward flow and then to a generally forward flow towards the intake conduit;

wherein the duct system further comprises port and starboard baffles that extend alongside the port and starboard intake ports and direct flow of water into port and starboard channels located alongside the port and starboard baffles, respectively, wherein the port and starboard channels drain the water by gravity from the outboard motor; and wherein the duct system further comprises a crossover channel that laterally connects the port and starboard channels, the crossover channel permitting lateral flow of water from the port intake port to the starboard intake trough or from the starboard intake port to the port intake trough, depending on tilt and trim orientations of the outboard motor.

3. The cowling according to claim 2, further comprising port and starboard drainage ports that drain water from the port and starboard drainage channels.

4. The cowling according to claim 3, wherein when the outboard motor is trimmed upwardly and steered towards the starboard side, water drains from the port channel to the crossover channel, from the crossover channel to the starboard intake port, and from the starboard channel to the starboard intake port.

5. The cowling according to claim 4, wherein when the outboard motor is trimmed up and steered towards the port side, water drains from the starboard channel to the crossover channel, from the crossover channel to the port intake port, and from the port channel to the port intake port.

6. The cowling according to claim 5, wherein when the outboard motor is trimmed down, water drains from the crossover channel to the port and starboard channels and from the port and starboard channels to the port and starboard drainage ports.

7. A cowling for an outboard motor, the cowling extending from top to bottom in a vertical direction, from port side to starboard side in a lateral direction that is perpendicular to the vertical direction, and from forward side to aftward side in an axial direction that is perpendicular to the vertical direction and perpendicular to the lateral direction, the cowling comprising:

port and starboard intake ports that direct flow of intake air into the cowling, the port and starboard intake ports extending downwardly along the aftward side of the cowling and facing outwardly in the lateral direction; and a duct system located in the cowling, the duct system being configured to receive and convey intake air from the port and starboard intake ports to an intake conduit for the outboard motor;

wherein the duct system comprises port and starboard intake troughs that extend alongside the port and starboard intake ports and redirect the intake air from a generally lateral flow into the port and starboard intake ports to a generally vertically downward flow and then to a generally forward flow towards the intake conduit; and wherein the duct system further comprises a plurality of port walls that are spaced apart from each other along the port intake trough in the axial direction and laterally extend into the port intake trough and a plurality of starboard walls that are spaced apart from each other along the starboard intake trough in the axial direction and laterally extend into the starboard intake trough.

8. The cowling according to claim 7, wherein spaces defined between the port walls and between the starboard walls provide flow paths for the intake air as the intake air is redirected from the generally lateral flow to the generally vertically downward flow.

9. The cowling according to claim 8, wherein the port and starboard intake troughs each comprises a base wall and a sidewall that extends upwardly from the base wall, and wherein the port and starboard walls extend laterally outwardly from the base walls of the port and starboard intake troughs, respectively.

10. A cowling for an outboard motor, the cowling extending from top to bottom in a vertical direction, from port side to starboard side in a lateral direction that is perpendicular to the vertical direction, and from forward side to aftward side in an axial direction that is perpendicular to the vertical direction and perpendicular to the lateral direction, the cowling comprising:

port and starboard intake ports that direct flow of intake air into the cowling, the port and starboard intake ports extending downwardly along the aftward side of the cowling and facing outwardly in the lateral direction; and a duct system located in the cowling, the duct system being configured to receive and convey intake air from the port and starboard intake ports to an intake conduit for the outboard motor;

wherein the duct system comprises port and starboard intake troughs that extend alongside the port and starboard intake ports and redirect the intake air from a generally lateral flow into the port and starboard intake ports to a generally vertically downward flow and then to a generally forward flow towards the intake conduit;

wherein the duct system further comprises a plurality of port walls that are spaced apart from each other in the axial direction and laterally extend into the port intake trough and a plurality of starboard walls that are spaced apart from each other in the axial direction and laterally extend into the starboard intake trough;

wherein spaces defined between the port walls and between the starboard walls provide flow paths for the intake air as the intake air is redirected from the generally lateral flow to the generally vertically downward flow;

wherein the port and starboard intake troughs each comprises a base wall and a sidewall that extends upwardly from the base wall, and wherein the port and starboard walls extend laterally outwardly from the base walls of the port and starboard intake troughs, respectively; and wherein the port and starboard baffles each comprises an elongated baffle body that has a laterally outer side coupled to an interior surface of the cowling and an inner side having a raised curved upper surface, wherein the respective port and starboard channels are located laterally between the raised curved upper surface and the interior surface of the cowling.

11. The cowling according to claim 10, wherein the raised curved upper surface extends downwardly and laterally alongside a laterally outer edge of the respective port walls and starboard walls.

12. The cowling according to claim 2, wherein together the port and starboard intake troughs and crossover trough form a U shape.

13. The cowling according to claim 1, wherein the intake conduit for the outboard motor extends generally forwardly from lower ends of the port and starboard intake troughs.

14. A cowling for an outboard motor, the cowling extending from top to bottom in a vertical direction, from port side to starboard side in a lateral direction that is perpendicular to the vertical direction, and from forward side to aftward side in an axial direction that is perpendicular to the vertical direction and perpendicular to the lateral direction, the cowling comprising:

port and starboard intake ports that direct flow of intake air into the cowling, the port and starboard intake ports extending downwardly along the aftward side of the cowling and facing outwardly in the lateral direction; and a duct system located in the cowling, the duct system being configured to receive and convey intake air from the port and starboard intake ports to an intake conduit for the outboard motor;

wherein the duct system comprises port and starboard baffles that extend alongside the port and starboard intake ports and direct flow of water into port and starboard channels located alongside the port and starboard baffles, respectively, wherein the port and starboard channels drain the water by gravity from the outboard motor; and wherein the duct system further comprises a crossover channel that laterally connects the port and starboard channels, the crossover channel permitting lateral flow of water from the port intake port to the starboard intake trough or from the starboard intake port to the port intake trough, depending on tilt and trim orientations of the outboard motor.

15. The cowling according to claim 14, wherein the duct system further comprises a plurality of port walls that are spaced apart from each other in the axial direction and extend laterally into the port intake trough and a plurality of starboard walls that are spaced apart from each other in the axial direction and extend laterally into the starboard intake trough.

16. The cowling according to claim 15, wherein spaces defined between the plurality of port walls and between the plurality of starboard walls provide flow paths for the intake air as the intake air is redirected from the generally lateral flow to the generally vertically downward flow.

17. The cowling according to claim 15, wherein spaces defined between the plurality of port walls and between the plurality of starboard walls cause the intake air to travel in a circular motion, thereby separating water droplets from the intake air, the water droplets draining from the port and starboard drainage channels.

18. The cowling according to claim 15, wherein the plurality of port walls and plurality of starboard walls reduce speed of water entering the cowling during a sudden boat stop and direct the water towards the port and starboard channels.

19. A cowling for an outboard motor, the cowling extending from top to bottom in a vertical direction, from port side to starboard side in a lateral direction that is perpendicular to the vertical direction, and from forward side to aftward side in an axial direction that is perpendicular to the vertical direction and perpendicular to the lateral direction, the cowling comprising:

a peak that is axially located between the forward and aftward sides;

port and starboard sidewalls that extend aftwardly from the peak and vertically downwardly from opposite sides of a laterally central portion of the aftward side;

port and starboard intake ports that direct flow of intake air into the cowling, the port and starboard intake ports being formed through the port and starboard sidewalls and extending downwardly along only the aftward side of the cowling; and a duct system located in the cowling, the duct system being configured to receive and convey intake air from the port and starboard intake ports to an intake conduit for the outboard motor.

20. The cowling according to claim 19, wherein the peak is defined by a laterally elongated top edge.

21. The cowling according to claim 20, wherein the aftward side further comprises laterally outer surfaces located on opposite sides of the laterally central portion, and along which water can be conveyed into the port and starboard intake ports.

22. The cowling according to claim 21, further comprising aftward sidewalls located on opposite sides of the laterally central portion, aftwardly of the peak, and wherein the aftward sidewalls extend transversely relative to the port and starboard sidewalls.

23. The cowling according to claim 19, wherein the duct system comprises port and starboard intake troughs that extend alongside the port and starboard intake ports and redirect the intake air from a generally lateral flow into the port and starboard intake ports to a generally vertical downward flow and then to a generally forward flow towards the intake conduit.

24. The cowling according to claim 19, wherein the duct system further comprises port and starboard baffles that extend alongside the port and starboard intake ports and direct flow of water into port and starboard channels located alongside the port and starboard baffles, respectively, wherein the port and starboard channels drain water by gravity from the outboard motor.

25. The cowling according to claim 19, wherein the port and starboard sidewalls are generally parallel with respect to each other.

26. The cowling according to claim 19, wherein the port and starboard intake ports have a generally triangular shape.

27. The cowling according to claim 26, wherein the triangular shape has a top end located aftwardly of the peak and a bottom end located further from the peak than the top end, and wherein the top end is larger than the bottom end.

* * * * *